US011840378B2

(12) United States Patent
Tatu et al.

(10) Patent No.: US 11,840,378 B2
(45) Date of Patent: Dec. 12, 2023

(54) VALVE APPARATUS AND CONTAINER INCLUDING THE SAME

(71) Applicant: Colgate-Palmolive Company, New York, NY (US)

(72) Inventors: Francis Tatu, Sea Girt, NJ (US); Juhi Solanki, New Brunswick, NJ (US); Scott Demarest, Loudon, TN (US); Mark Bartlett, North East, PA (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/786,080

(22) PCT Filed: Dec. 4, 2020

(86) PCT No.: PCT/US2020/070854
§ 371 (c)(1),
(2) Date: Jun. 16, 2022

(87) PCT Pub. No.: WO2021/127680
PCT Pub. Date: Jun. 24, 2021

(65) Prior Publication Data

US 2023/0029125 A1 Jan. 26, 2023

Related U.S. Application Data

(60) Provisional application No. 62/950,621, filed on Dec. 19, 2019.

(51) Int. Cl.
*B65D 47/20* (2006.01)
*B65D 35/46* (2006.01)

(52) U.S. Cl.
CPC ..... *B65D 47/2031* (2013.01); *B65D 35/46* (2013.01)

(58) Field of Classification Search
CPC . B05B 11/007; B05B 11/0072; B05B 11/047; B65D 47/2018; B65D 47/2025;
(Continued)

(56) References Cited

U.S. PATENT DOCUMENTS 4,616,768 A 10/1986 Flier
4,749,108 A * 6/1988 Dornsbusch ..... B65D 23/00 222/545

(Continued)

FOREIGN PATENT DOCUMENTS

| | | |
|---|---|---|
| EP | 0160336 | 11/1985 |
| WO | 2013/138087 | 9/2013 |
| WO | 2021/127680 | 6/2021 |

OTHER PUBLICATIONS

International Search Report and the Written Opinion of the International Searching Authority issued in International Application PCT/US2020/070854 dated Mar. 17, 2021.

*Primary Examiner* — Donnell A Long

(57) ABSTRACT

A container (100) is provided that includes a chamber (102), a dispensing passageway and a resilient valve (120). The chamber contains a viscous fluidic material. The valve (120) is configured to transition from a normal state to a dispensing state upon a discharge pressure being applied to the chamber (102) to allow the viscous fluidic material to pass through the orifice (131) of the resilient valve and to be dispensed from the dispensing passageway as a string of the viscous fluidic material. The orifice (131) is open in the normal state. The valve is also configured to return from the dispensing state to the normal state upon cessation of the discharge pressure, whereby the resilient valve (120) assumes a pinching state while returning from the dispensing state to the normal state in which the string of the viscous fluidic material is pinched off by the orifice edge.

14 Claims, 24 Drawing Sheets

(58) Field of Classification Search
CPC ..... B65D 47/2031; B65D 47/2075; B65D 35/46; B65D 1/32
See application file for complete search history.

(56) References Cited

U.S. PATENT DOCUMENTS

| | | | | | |
|---|---|---|---|---|---|
| 5,033,655 | A * | 7/1991 | Brown | B29C 66/542 285/423 |
| 5,115,950 | A * | 5/1992 | Rohr | B65D 47/2031 222/212 |
| 5,213,236 | A * | 5/1993 | Brown | B65D 47/2031 220/203.18 |
| 5,271,531 | A * | 12/1993 | Rohr | B65D 47/0833 222/212 |
| 5,927,549 | A | 7/1999 | Wood | |
| 6,045,004 | A | 4/2000 | Elliott | |
| 6,050,451 | A | 4/2000 | Hess, III et al. | |
| 6,186,374 | B1 | 2/2001 | Gross | |
| 6,494,346 | B2 | 12/2002 | Gross et al. | |
| 6,749,092 | B2 | 6/2004 | Olechowski et al. | |
| 6,951,295 | B1 | 10/2005 | Gaus et al. | |
| 7,543,724 | B2 | 6/2009 | Brunner et al. | |
| 2007/0295764 | A1 | 12/2007 | Socier | |
| 2017/0021976 | A1 * | 1/2017 | Wang | B29C 49/4278 |

* cited by examiner

VALVE APPARATUS AND CONTAINER INCLUDING THE SAME

CROSS-REFERENCE TO RELATED APPLICATIONS

This application claims the benefit of U.S. Provisional Patent Application No. 62/950,621, filed Dec. 19, 2019. The disclosure of the above application is incorporated herein by reference.

BACKGROUND

Containers exist in which a fluidic material, such as a dentrifice, is stored and dispensed. Such containers typically include a nozzle and cap. In a closed configuration the cap prevents the fluidic material from being released from the container, and in the open configuration the cap permits the fluidic material to be released from the container. Oftentimes, however, when the cap is in an open configuration and the user desires to be finished with dispensing the fluidic material, remnants of the fluidic material continue to be dispersed. Such continued dispersion of the fluidic material causes a mess that is undesired by the user. An example of this includes toothpaste that continues to be released from a toothpaste tube after a user ceases putting pressure upon the toothpaste tube. Thus, a need exists for a container that can dispense fluidic materials, such as dentifrice, without dispensing an undesired amount of the dentrifice onto the toothbrush or other areas.

BRIEF SUMMARY

The present invention is directed to a container. In an aspect the container may include a chamber, a dispensing passageway, and/or a valve. The chamber may contain a viscous fluidic material. The dispensing passageway may be configured to discharge the viscous fluidic material from the chamber. The valve may be operably coupled to the dispensing passageway. The valve may be resilient and may include a valve head and an orifice in the valve head. The orifice may be defined by an orifice edge of the valve head. The valve may be configured to transition from a normal state to a dispensing state upon a discharge pressure being applied to the chamber to allow the viscous fluidic material to be pass through the orifice of the resilient valve and be dispensed from the dispensing passageway as a string of the viscous fluidic material. The orifice may be open in the normal state. The valve may also, or alternatively, be configured to return from the dispensing state to the normal state upon cessation of the discharge pressure. The resilient valve may assume a pinching state while returning from the dispensing state to the normal state in which the string of the viscous fluidic material is pinched off by the orifice edge.

In another aspect a resilient valve for controlling the dispensing of a viscous fluidic material may be provided. The resilient valve may include a valve head comprising a first surface and a second surface opposite the first surface and an orifice in the valve head. The orifice may be defined by an orifice edge of the valve head. The resilient valve may be configured to transition from a normal state to a dispensing state upon a discharge pressure being applied to the first surface of the valve head to allow the viscous fluidic material to pass through the orifice as a string of the viscous fluidic material. The orifice may be open in the normal state. The may be configured to return from the dispensing state to the normal state upon cessation of the discharge pressure, the resilient valve assuming a pinching state while returning from the dispensing state to the normal state in which the string of the viscous fluidic material is pinched off by the orifice edge.

In another aspect a method of dispensing a viscous fluidic material from a container includes a resilient valve positioned in a dispensing passageway transitioning from a normal state to a dispensing state upon a discharge pressure being applied to a chamber of the container. The transitioning from the normal state to the dispensing state allowing the viscous fluidic material to pass through an orifice of the resilient valve, the orifice being open in the normal state. Upon cessation of the discharge pressure, the resilient valve may return from the dispensing state to the normal state. The resilient valve may assume a pinching state while returning from the dispensing state to the normal state in which the string of the viscous fluidic material is pinched off by the orifice edge.

Further areas of applicability of the present invention will become apparent from the detailed description provided hereinafter. It should, be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
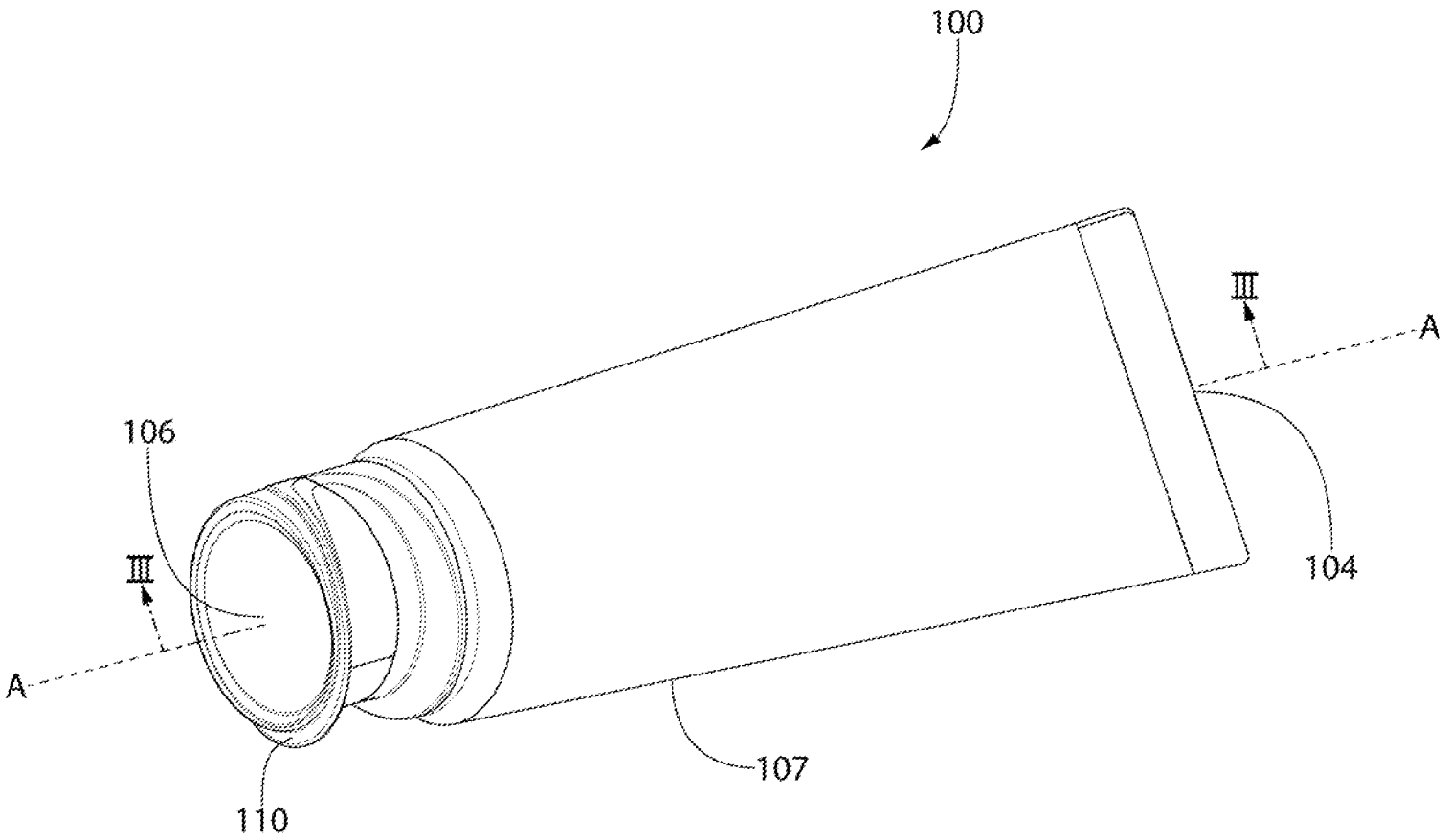
FIG. 1 shows a perspective view of an example container in a closed configuration, as described herein.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Embodiments of the present invention will now be described with respect to one or more personal care treatment systems. The personal care treatment systems may relate to oral care or oral treatment systems, for example. Embodiments of the oral care system may include a container that may store and/or dispense, without limitation, one or more of the following oral care fluids: tooth cleaning (e.g., dentrifice), tooth whitening, antibacterial, enamel protection, anti-sensitivity, anti-inflammatory, anti-attachment, fluoride, tartar control/protection, flavorant, sensate, colorant and others. However, other embodiments of the present invention may be used to store and dispense any suitable type of personal care fluid, and the invention is not limited to any particular personal care system or fluid alone.

Figure 2:
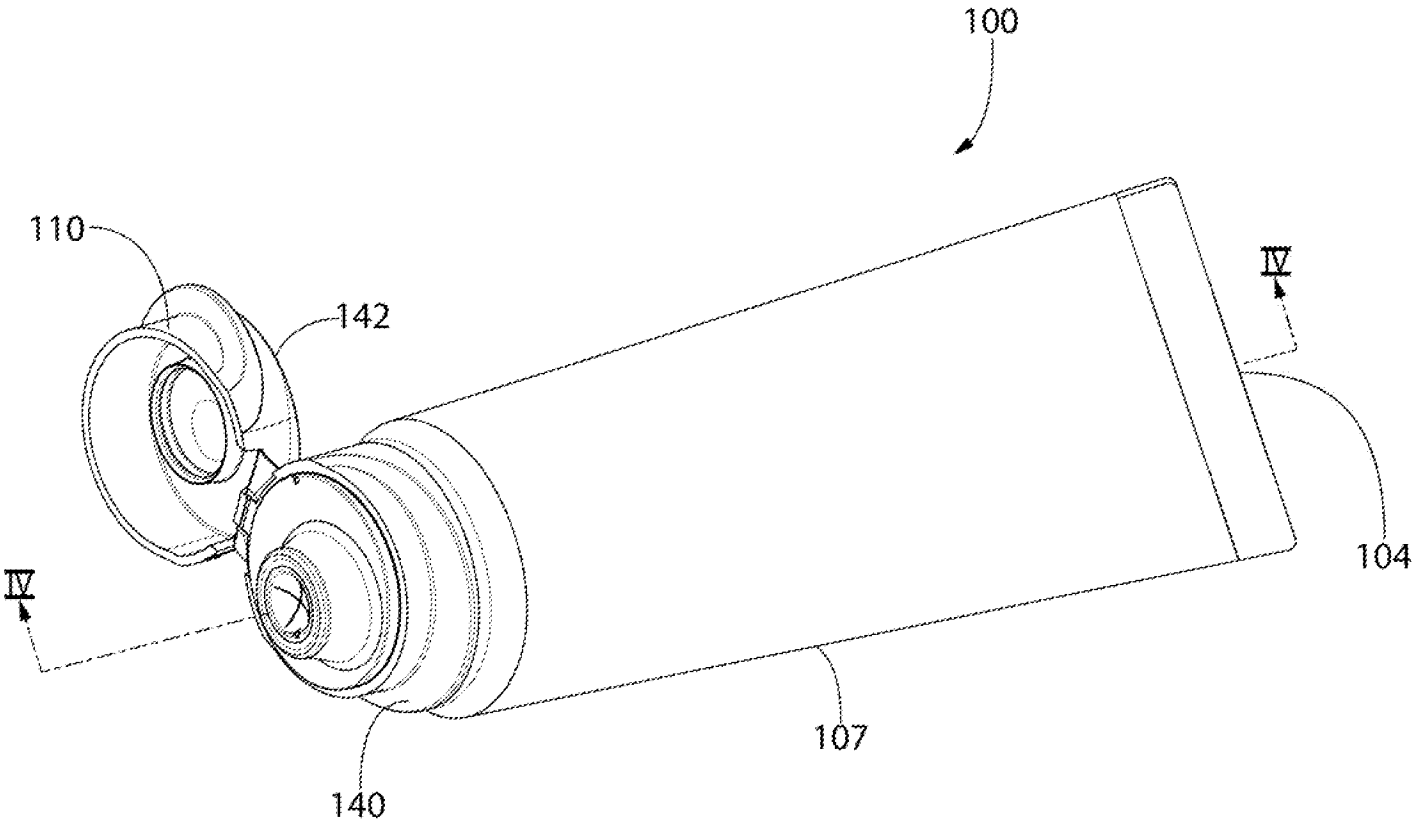
FIG. 2 shows a perspective view of an example container in an open configuration, as described herein.

Referring first to FIG. 1, an example container 100 is illustrated in an open configuration according to an embodiment of the present invention. FIG. 2 shows an example container 100 configured in a closed configuration. Container 100 may be a dispenser of a personal care and/or oral care fluid. For example, container 100 may be a toothpaste dispenser, although the container may dispense one or more other fluids in other examples. The fluids may be a viscous fluidic material. For example, the viscous fluidic material may have a viscosity in the range of 50,000-420,000 centipoise (cps), such as in the range of 70,000-100,000 cps.

The fluids stored and/or dispensed by the container 100 may be one or more fluids which provide oral health benefits to a user. In an embodiment, the oral care fluid may include a tooth cleaning solution (such as a dentrifice), but the oral care fluid is in no way limited to a tooth cleaning solution and may include fluids having active or inactive agents that deliver therapeutic, cosmetic, experiential and/or sensorial benefits to a tooth, soft tissue, tongue, or other portions of a consumer, such as to the consumer's oral cavity. The fluids may be a dentrifice, an anti-sensitivity agent, a fluoride, a tartar protection agent, an antibacterial agent, an oxidative or whitening agent, an enamel strengthening or repair agent, a tooth erosion preventing agent, a tooth sensitivity ingredient, a gum health active, a nutritional ingredient, a tartar control or anti-stain ingredient, an enzyme, a sensate ingredient, a flavor or flavor ingredient, a breath freshening ingredient, an oral malodor reducing agent, an anti-attachment agent or sealant, a diagnostic solution, an occluding agent, a dry mouth relief ingredient, a catalyst to enhance the activity of any of these agents, colorants or aesthetic ingredients, arginine bicarbonate, chlorohexidine, triclosan, CPC, zinc oxide, etc., including one or more combinations thereof.

As shown on FIG. 1 and FIG. 2, container 100 may extend along a longitudinal axis A-A from a proximal portion 104 of container 100 to a distal portion 106 of container 100. The distal portion 106 may be the dispensing portion of the container 100. For example, the distal portion 106 may include a cap 110 which may include a closure device to permit or prevent fluid from being released from container 100. Container 100 may include a sidewall 107. Sidewall may be cylindrically shaped in examples, although sidewall 107 may be shaped in one or more different configurations consistent with the purpose or use of the container 100. Container 100 may be integrally molded. As an example, container 100 may be integrally molded from a plastic or similar material. In other examples container 100 may be formed of one or more separate pieces.

Container 100 may include a closing device. For example, container 100 may include a cap 110. Cap 110 may be permanently affixed to the container 100 in examples. In such examples, cap 110 and the container 100 may be integrated into a single component. For example, the container 100 and the cap 110 may be sealed directly to one another.

Figure 3:
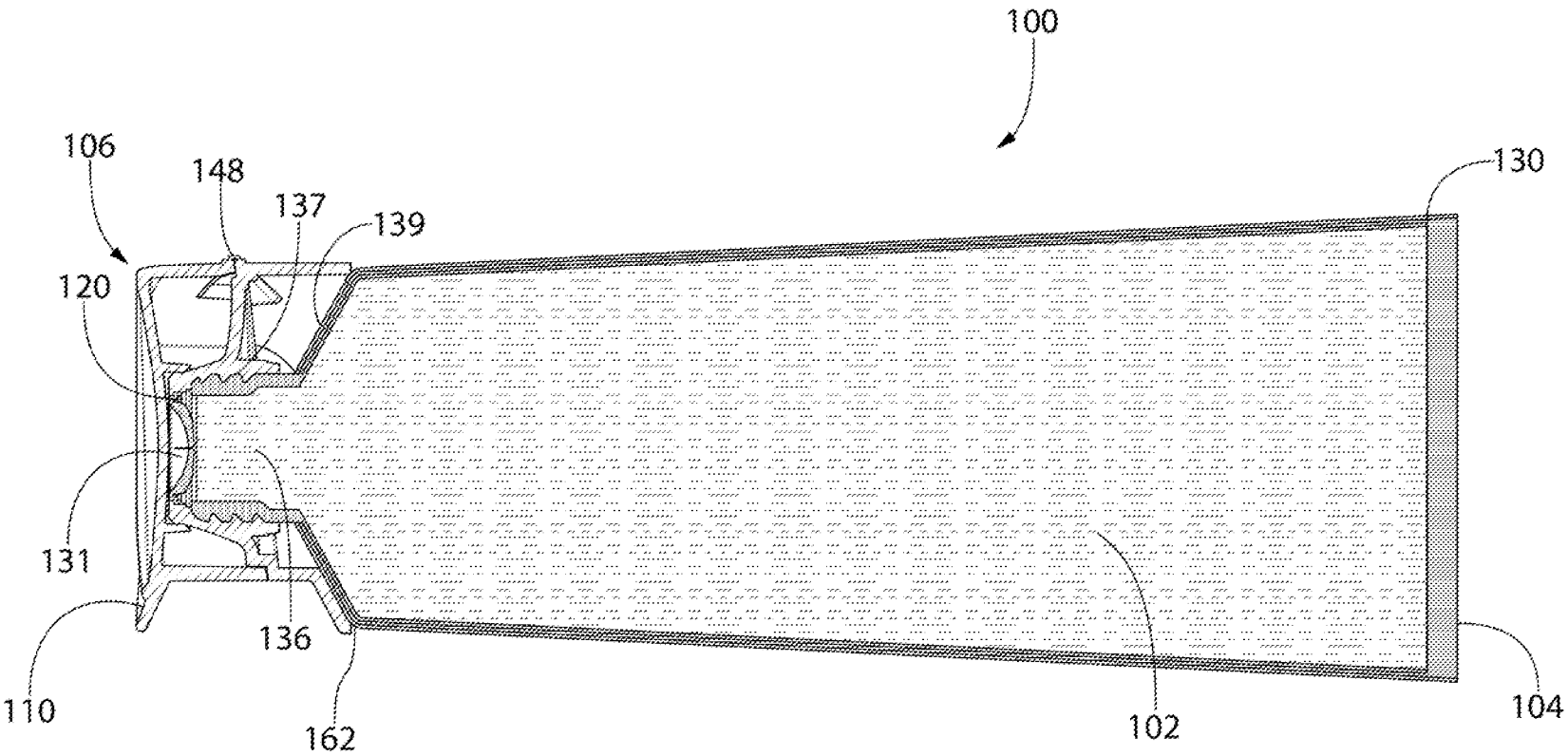
FIG. 3 is a side cross sectional view of the of the example container taken along line III-III in FIG. 1.
Figure 4:
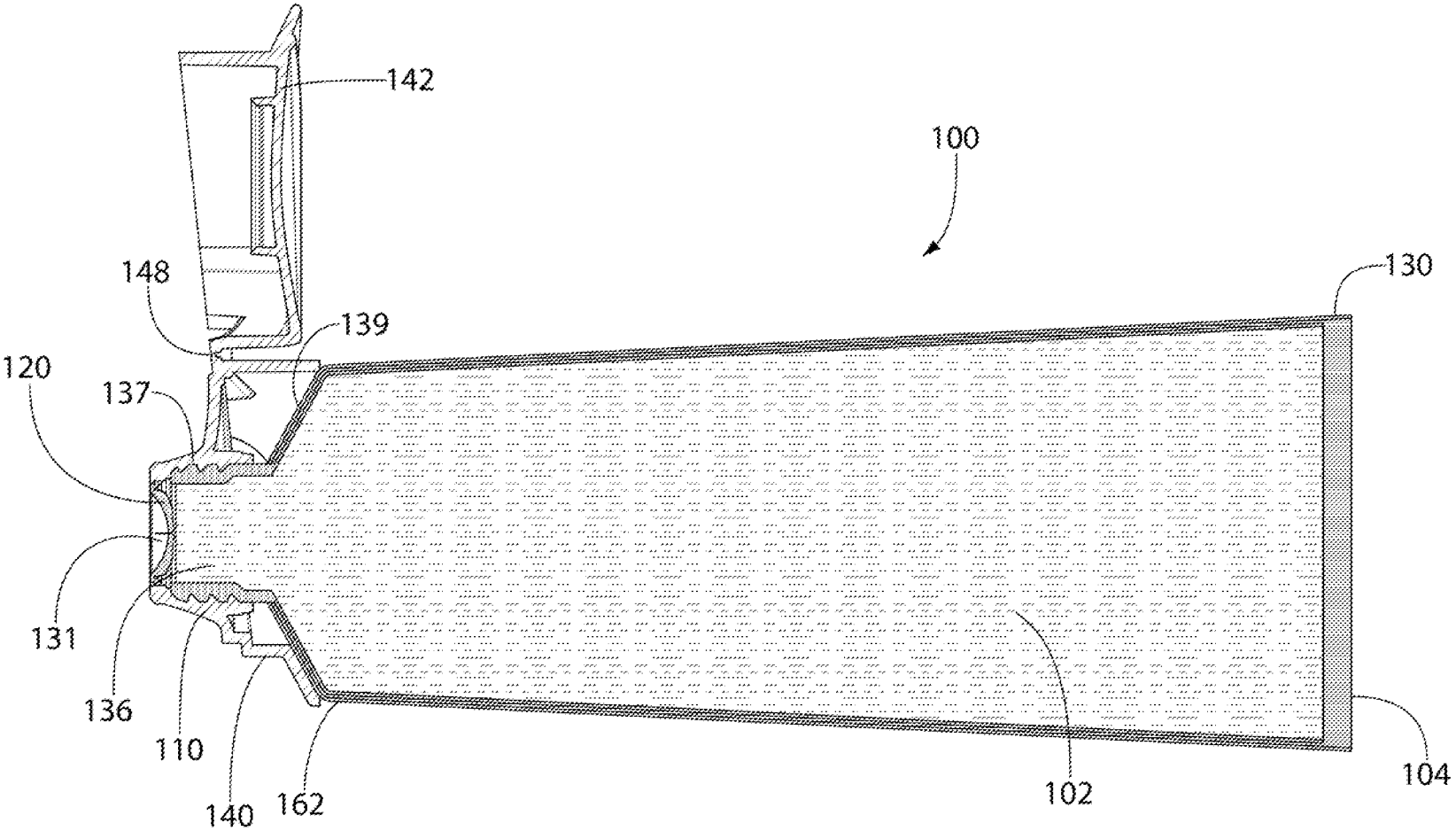
FIG. 4 is a side cross sectional view of the of the example container taken along line IV-IV in FIG. 2.

FIG. 3 shows a cross-sectional view of the example container in the closed configuration, as shown on FIG. 1. FIG. 4 shows a cross-sectional view of the example container in the open configuration, as shown on FIG. 2. As shown on FIGS. 3 and 4, container 100 may include chamber 102 and a dispensing passageway 136. In examples, fluid (e.g., a viscous fluid) may move from chamber 102 to outside of container 100 via dispensing passageway 136.

Container 100 may include a collapsible cavity, such as a collapsible tube. The collapsible cavity (e.g., tube) may be chamber 102 or may include chamber 102. Chamber 102 may be hollow or partially hollow. Chamber 102 may store and/or dispense a fluidic material, such as the viscous fluids described herein. In examples the proximal portion 104 of container 100 may be adjacent to, or aligned with, a bottom of the chamber 102. Chamber 102 may be compressible. For example, chamber 102 may be compressible via a squeezing of sidewall 107 which may cause the fluidic material to be moved from (e.g., discharged from) the chamber 102 via, a force. As an example, the force may move the fluidic material from chamber 102 and out of the container 100, for example, through dispensing passageway 136.

The collapsible tube may include a wall. As an example, the wall may form a multi-layer sheet that includes a flavor barrier layer. The flavor barrier may be formed of one or more materials, such as a copolymer material. Examples of the copolymer material may include ethylene vinyl alcohol (EVOH), although the copolymer material may include one or more other materials. The collapsible tube may generate a negative pressure. For example, upon cessation of the discharge pressure (e.g., upon cessation of the discharge pressure placed upon the collapsible tube), the collapsible tube may generate a negative pressure. The negative pressure may assist in returning valve 120 from the dispensing state to the normal state.

As described herein, cap 110 may be coupled to container 100. Cap 110 may be removeably or permanently coupled to container 100. In examples in which cap 110 is removably coupled to container 100, cap 110 may be coupled via a threading 137 located on container 100. Threading 137 may be formed as part of dispensing passageway 136. Threading 137 may extend from shoulders 139 that extend from chamber 102. In examples in which the cap 110 is integrated with container 100, shoulders may be excluded from container 100.

Chamber 102, shoulders 139, and/or cap 110 may be formed of one or more materials. For example, cap 110 may be formed of Polypropylene (PP) and/or the shoulders 139 may be formed of Polyethylene, although one or more other materials may be used to form these or other portions of container 100. As an example, container 100 may include a flavor barrier insert that may be made of Polyethylene terethalate or another barrier material such as Ethylene vinyl alcohol, silicone oxide coatings, etc.

As shown on FIG. 3, cap 110 may include a closure component that may close upon chamber 102 such as to prevent fluid from being dispensed from chamber 102. In other examples, as shown on FIG. 4, cap 110 may open so as to allow fluid to be dispensed from chamber 102. Cap 110 may close (FIG. 3) and/or open (FIG. 4) upon an internal chamber of container 100 via a hinge mechanism 148.

For example, hinge mechanism 148 may couple a bottom portion 140 of cap 110 with the top portion 142 of cap 110. Bottom portion 140 and/or top portion 142 of cap 110 may define a perimeter. Bottom portion 140 may include dispensing passageway 136, although dispensing passageway 136 may be formed absent bottom portion 140. Dispensing passageway 136 may form a cylindrical or round spout (e.g., a nozzle), although dispensing passageway 136 may be or include one or more other form factors. The nozzle may be formed of plastic (e.g., hard plastic) and/or may include a portion of dispensing passageway 136. Container 100 may include a nozzle component. Nozzle component may include an upper surface. The nozzle may protrude from the upper surface of nozzle component. A perimeter edge of the upper surface may define a perimeter. Perimeter may have a center, for example, when viewed from above. In examples an axis derived from nozzle may be spaced a distance from the center of the perimeter. The axis derived from nozzle may be spaced a distance from the center of the perimeter in a first direction.

Hinge mechanism 148 may couple nozzle component with closure component. Hinge mechanism 148 may be located a distance from the center of the perimeter. For example, the hinge mechanism 148 may be located a distance from the center of the perimeter, in a second direction. The second direction may be opposite the first direction.

Bottom portion 140 of cap 110 may include dispensing passageway 136 (e.g., nozzle). Bottom portion 140 may be, or include, nozzle component. Top portion 142 may be, or include, closure component. Closure component may close dispensing passageway 136 (e.g., nozzle). Opening the cap 110 (e.g., via hinge mechanism 148) may expose the dispensing passageway 136 and closing the cap 110 may close off dispensing passageway 136.

Container 100 may include a valve 120. Opening the cap 110 (e.g., via hinge mechanism 148) may expose the valve 120, as described herein. Valve 120 may be coupled to container 100. For example, valve 120 may be coupled to container 100 via dispensing passageway 136 (e.g., nozzle), shoulders 139, cap 110, and/or one or more locations (e.g., other locations) of container 100. Valve 120 may be integrally formed with container 100. For example, valve 120 may be overmolded to a portion (e.g., dispensing passageway 136, nozzle within a portion of dispensing passageway 136, etc.) of container 100.

As described herein, cap 110 may be detachably coupled to container 100 and/or cap 110 and container 100 may be integrated (e.g., molded) into a single component. Cap 110 may be configured to prevent the fluid from flowing out of container 100 (e.g., chamber 102 of container 100) through dispensing passageway 136 and/or valve 120. In other examples cap 110 may be configured to allow the fluid to flow out of container 100 (e.g., chamber 102 of container 100) through dispensing passageway 136 and/or valve 120. As described herein, cap 110 may move from an open configuration to a closed configuration via hinging mechanism 148. In examples, the hinging mechanism 148 may be formed from a piece of material (e.g., a thin piece of material) connecting a bottom portion 140 of the cap 110 with a top portion 142 of the cap 110.

Chamber 102 may include a proximal end 130 and a distal end 102. Proximal end 130 of chamber 102 may coincide with proximal portion 104 of container 100. Shoulders 139 may form from (e.g., extend from) distal end 102 of chamber 102. In examples, shoulders 139 may taper from the chamber 102. Shoulders 139 may form a portion of dispensing passageway 136, although shoulders 139 and dispensing passageway 136 may be separate components in examples.

Dispensing passageway 136 may protrude from the distal end 162 of the chamber 102 and/or towards distal portion 106 of container 100. The nozzle may terminate at the distal most surface (e.g., annular distal-most surface) defining a dispensing opening of the dispensing passageway 136. In examples dispensing passageway 136 may extend into the distal end 162 of chamber 102. Dispensing passageway 136 may extend to the distal end 162 of chamber 102 or dispensing passageway 136 may protrude into the chamber 102 beyond the distal end 162 of the chamber 102.

Figure 5:
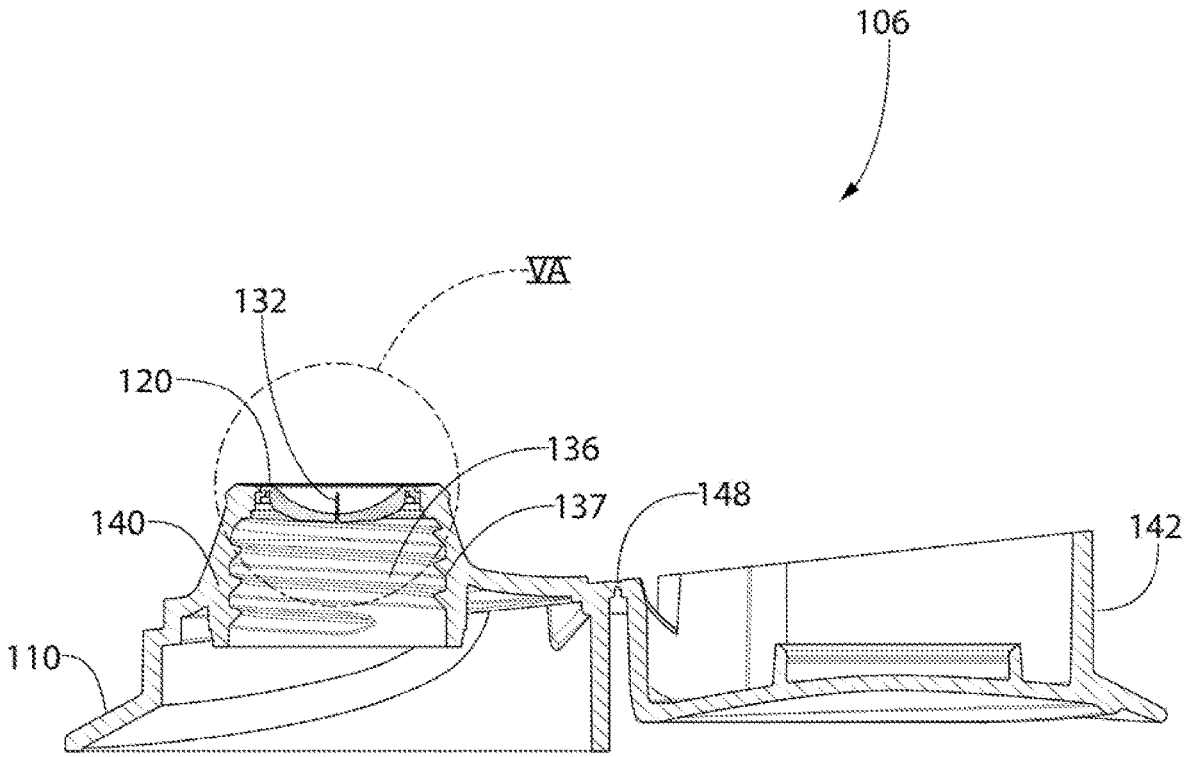
FIG. 5 is a side view of an example top portion of the example container in which the cap is in an open configuration, as described herein.
Figure 6:
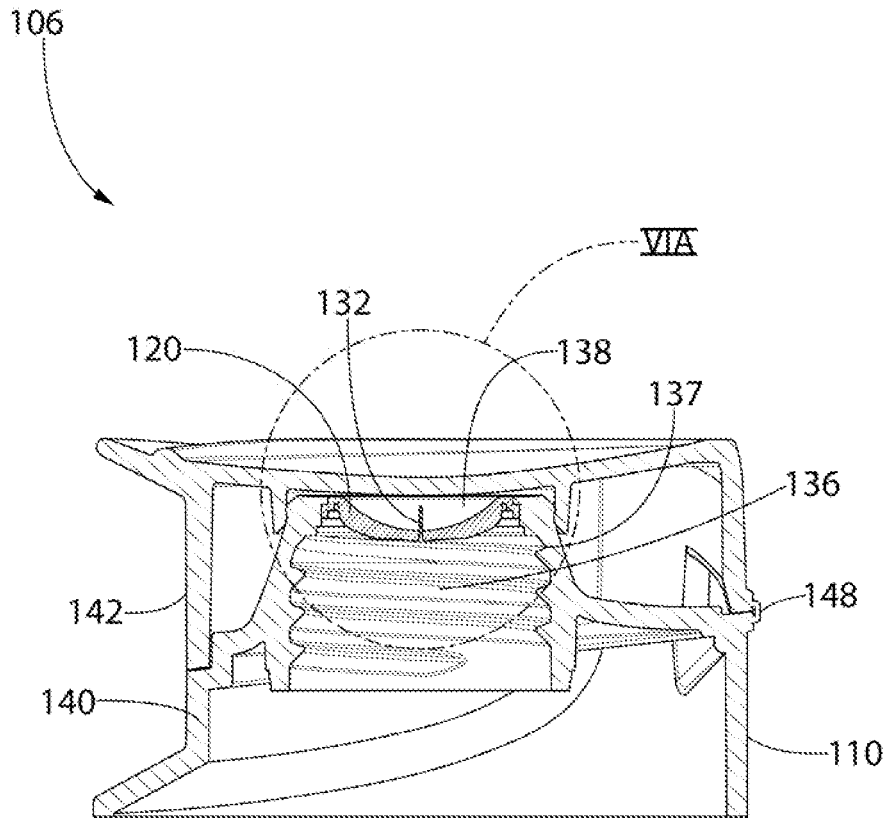
FIG. 6 is a side view of an example top portion of the example container in which the cap is in a closed configuration, as described herein.

FIG. 5 shows an example distal portion 106 of container 100 in which cap 110 is in an open state. FIG. 6 shows an example distal portion 106 of container 100 in which cap 110 is in a closed state. Distal portion 106 may include a top portion 142 of cap, bottom portion 140 of cap, hinging mechanism 148 of cap, and/or dispensing passageway 136. In examples in which cap 110 and container 100 are not coupled, distal portion 106 may not include cap 110. Distal portion 106 may include valve 120. Valve 120 may be coupled to dispensing passageway 136 and/or may be positioned within or about the bottom portion 140 of cap 110.

Valve 120 may define an orifice 131 through which the fluidic material may be permitted to pass or through which the fluidic material may be prevented from passing. One or more portions of valve 120 may be resilient. For example, one or more portions of valve 120 (e.g., flaps 138) may be configured to recoil or spring back into shape after bending, stretching, being compressed, or the like. Orifice 131 may be formed during formation of valve 120. For example, orifice 131 may be formed during an overmolding process that forms valve 120. Valve 120 may include one or more slits 132 that may form one or more flaps 138. For example, one or more of the slits may intersect one or more of the other slits to form one or more flaps 138.

Orifice 131 may be defined within, or about, dispensing passageway 136. Orifice 131 may define a passage in which the fluid may pass from the chamber 102 to the outside of the container 100. The fluid may pass through orifice 131 when flaps 138 of valves are in an opened position. The fluid may be prevented from passing through orifice 131 when flaps 138 of valves are in a closed position. As shown on FIG. 5, valve 120 may comprise one or more convex surfaces. For example, valve 120 may include a convex inner surface and/or a convex outer surface.

Figure 5A:
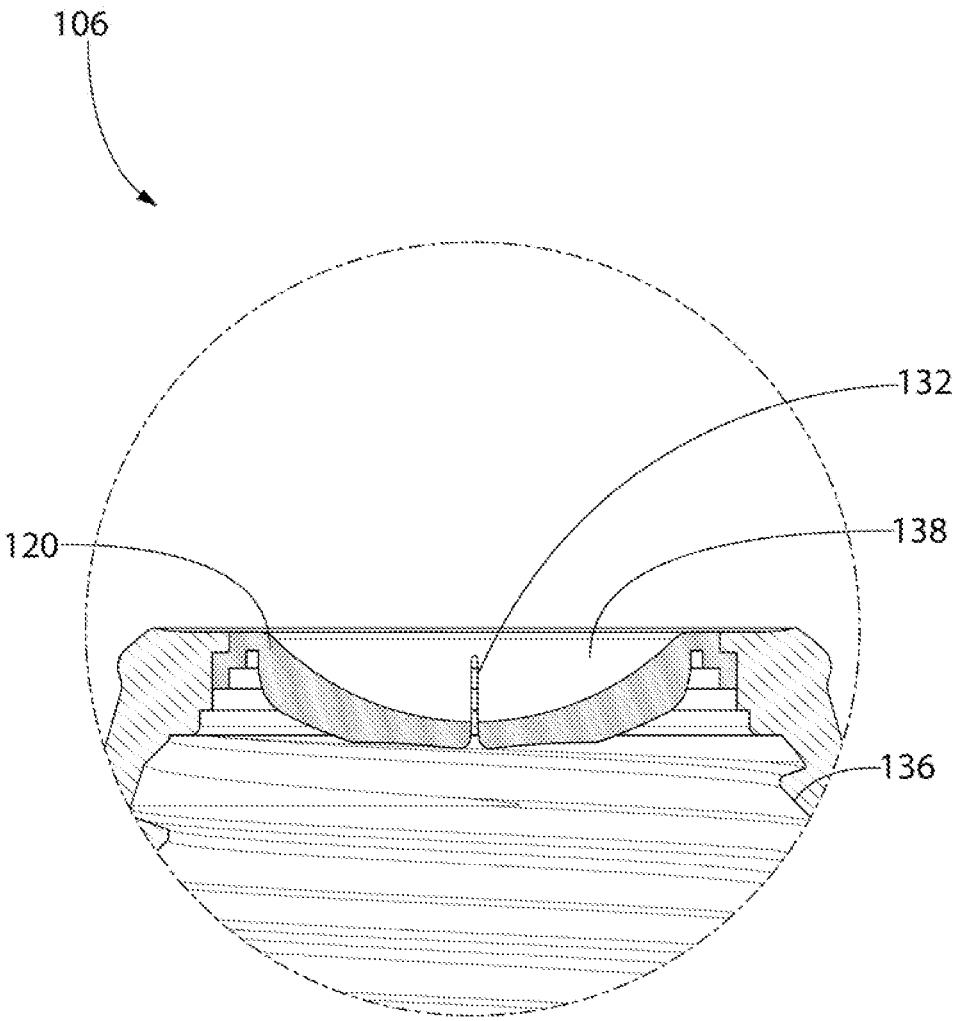
FIG. 5A is an exploded view of the example top portion of container, as shown on FIG. 5.
Figure 6A:
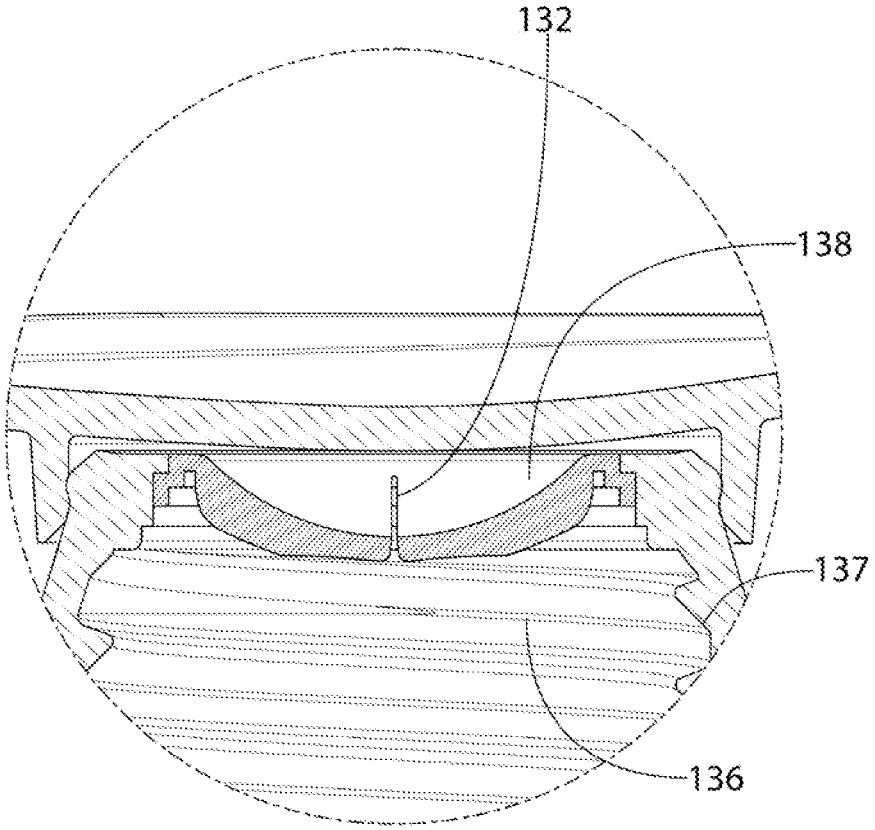
FIG. 6A is an exploded view of the example top portion of container, as shown on FIG. 6.

FIG. 5A shows an exploded view of cap 110, dispensing passageway 136, and valve 120 in an opened configuration, as shown in FIG. 5. FIG. 6A shows an exploded view of a cap 110, dispensing passageway 136, and valve 120 in a closed configuration, as shown in FIG. 6

Valve 120 may be coupled (e.g., operably coupled) to dispensing passageway 136. Valve 120 may be formed of a resilient material, such as a thermoplastic elastomer. For example, one or more portions of valve 120 may be formed of a plastic material, a rubber (e.g., silicone rubber) material, although valve 120 may be formed of one or more other materials which may be resilient and/or may not be resilient. As described herein, valve 120 may include one or more slits 132. The slits 132 may define an orifice 131 that opens and closes, which may allow fluidic material to pass out of container 100 or which may retain the fluidic material within container 100. The opening and closing of valve 120 (including a pinching configuration of portions of valve 120) is described further herein.

Figure 7A:
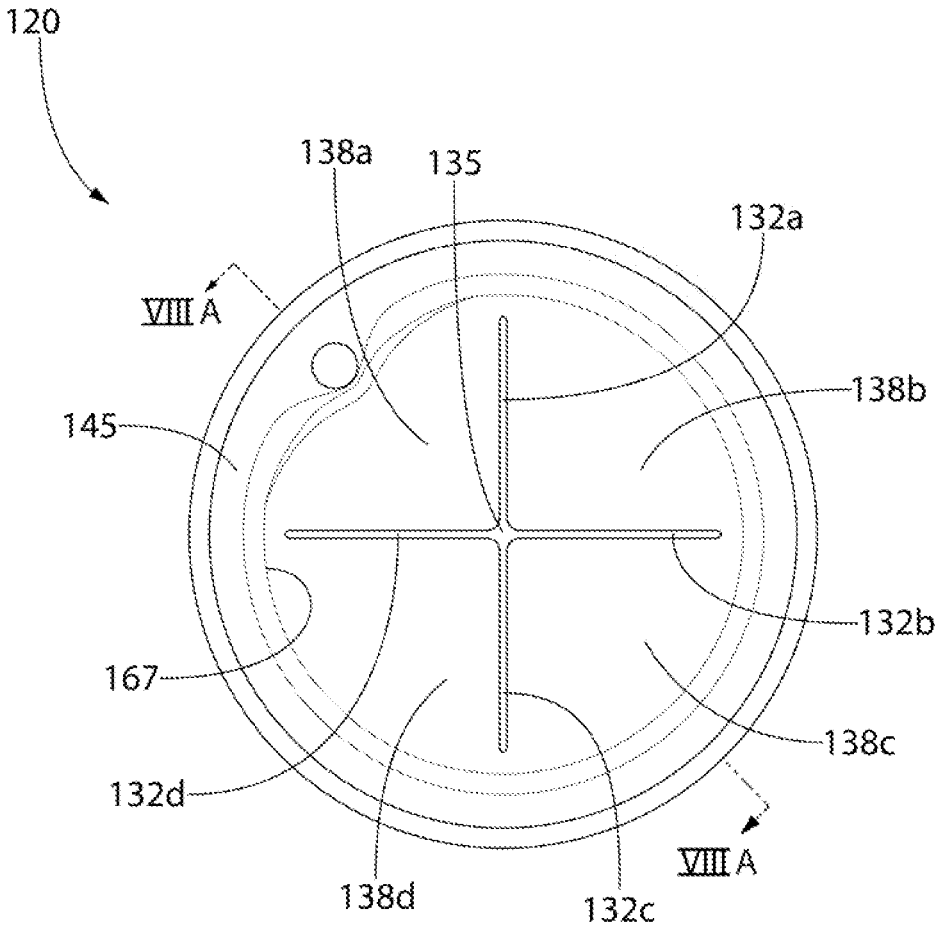
FIGS. 7A, 7B, 7C show a top view of example valves, as described herein.
Figure 7B:
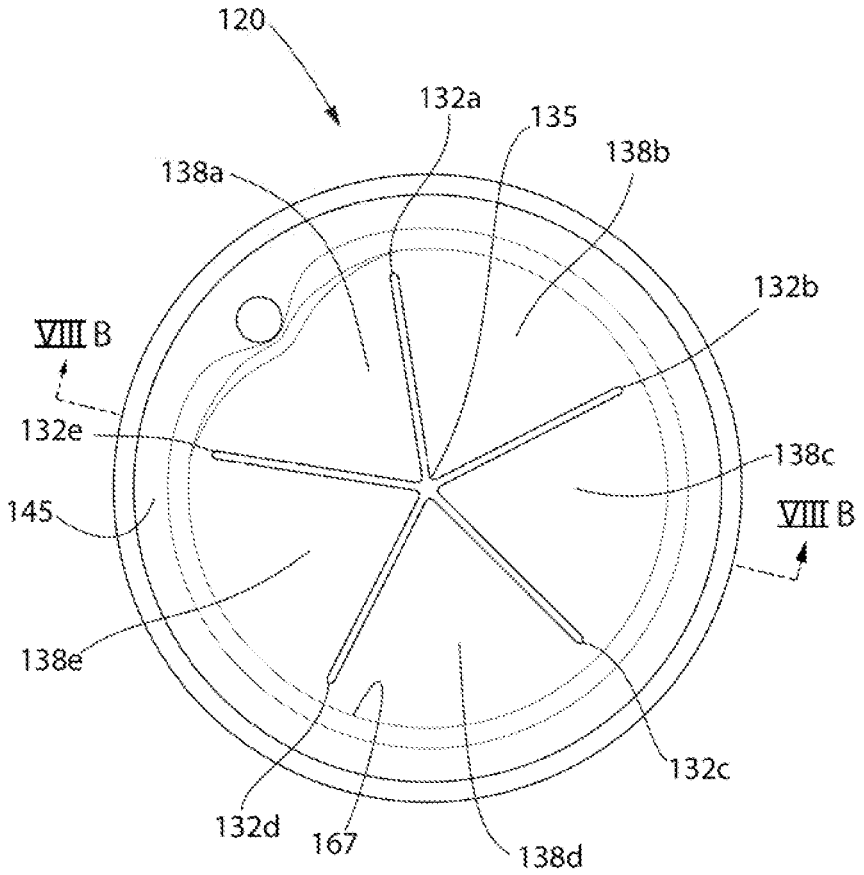
Figure 7C:
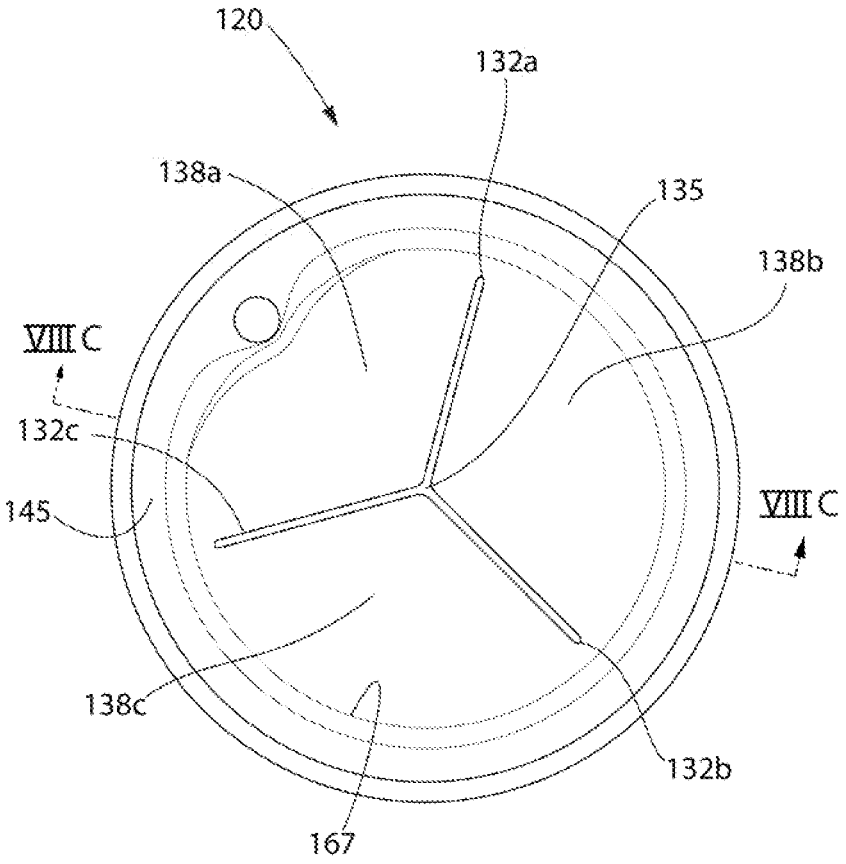

FIGS. 7A, 7B, 7C are top views of example valves, such as example valve 120. Valve 120 may include one or more slits and/or one or more flaps. For example, as shown on FIG. 7A, valve 120 may include one more slits 132*a*, 132*b*, 132*c*, 132*d*, which may form one or more flaps 138*a*, 138*b*, 138*c*, 138*d*, as described herein. Another example, as shown on FIG. 7B, may include valve 120 having one or more slits 132*a*, 132*b*, 132*c*, 132*d*, 132*e*, which him one Or more flaps 138*a*, 138*b*, 138*c*, 138*d*, 138*e*. In another example, as shown on FIG. 7C, valve 120 may include one more slits 132*a*, 132*b*, 132*c*, which may form one or more flaps 138*a*, 138*b*, 138*c*. Although examples herein describe three, four, or five slits and corresponding flaps, it should be understood that such examples are for illustration purposes only. Examples may include any variety of one or more slits and/or flaps, as described herein.

Slits may form an opening, such as opening 135. For example, as shown on FIG. 7A, slits 132*a*, 132*b*, 132*c*, 132*d* may form opening 135; as shown on FIG. 7B, slits 132*a*, 132*b*, 132*c*, 132*d*, 132*e* may form opening 135; and as shown on FIG. 7C, slits 132*a*, 132*b*, 132*c* may form opening 135. Opening 135 may be centrally formed between one or more of the slits, such as slits 132*a*, 132*b*, 132*c*, 132*d*. In other examples opening 135 may be off-center. Valve 120 may include a valve bead 145. Valve head 145 of valve 120 may define orifice 131 (FIG. 8). In an example the orifice 131 of the valve 120 may be defined by an orifice edge 167. Orifice edge 167 may be defined by valve head 145.

Figure 8A:
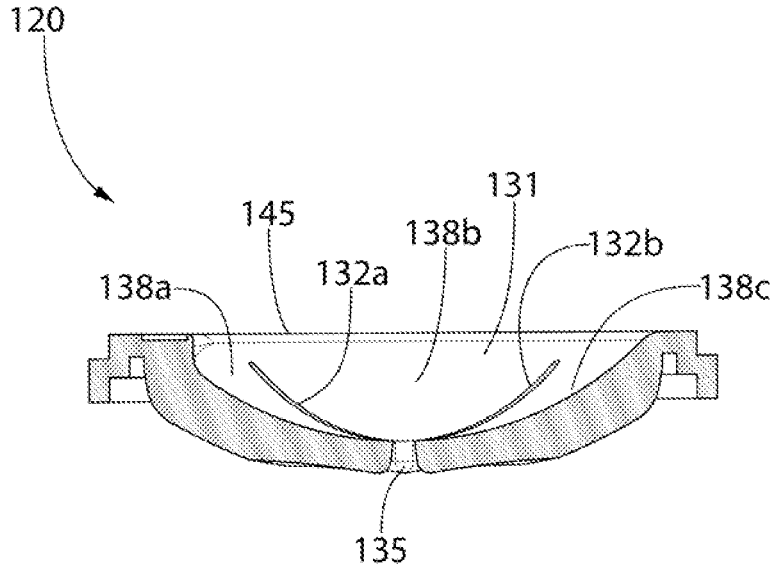
FIGS. 8A, 8B, 8C show side cross sectional views of the example valves taken along lines VIIIA-VIIIA, VIIIB-VIIIB, VIIIC-VIIIC in respective FIGS. 7A, 7B, 7C in which the valves are in a normal state, as described herein.
Figure 8B:
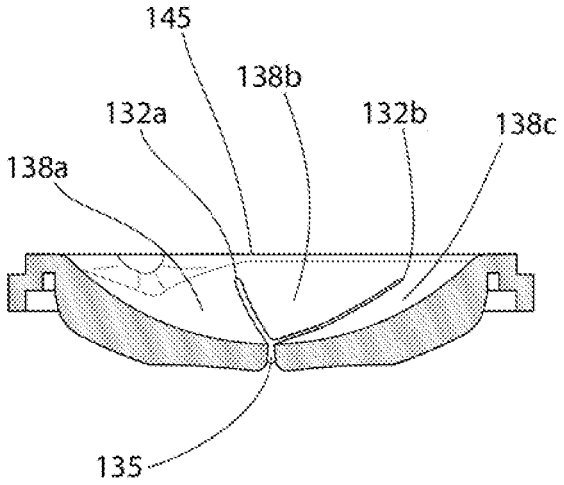
Figure 8C:
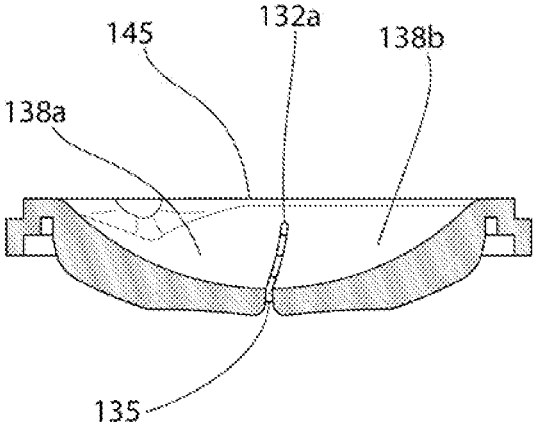
Figure 9:
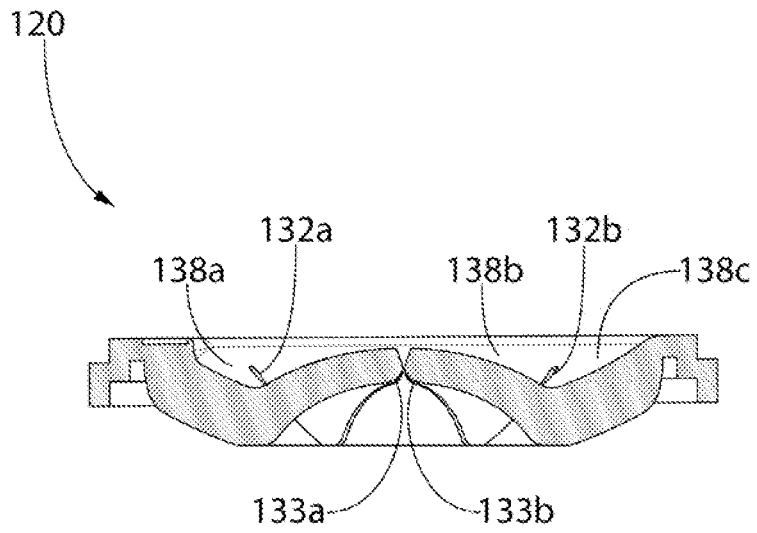
FIG. 9 is a side view of an example valve in a pinching state, as described herein.
Figure 10:
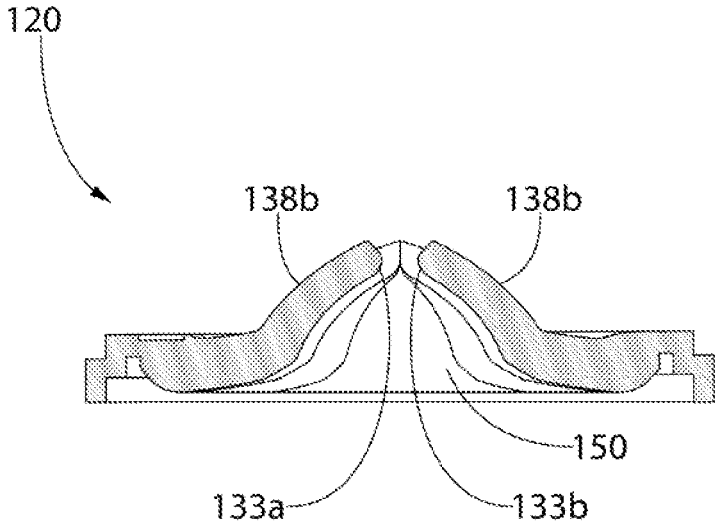
FIG. 10 is a side view of an example valve in a dispensing state, as described herein.

FIGS. 8-10 show example configurations of valve 120. For example, FIGS. 8-10 show example configurations of valve 120 in different states which will permit fluid to flow from an orifice 131 of the valve 120 or prohibit fluid from flowing from the orifice 131 of the valve 120.

FIG. 8A shows an example side cross sectional view of the valve 120 taken along line VIIIA-VIIIA in FIG. 7A. FIG. 8B shows an example side cross sectional view of the valve 120 taken along line VIIIB-VIIIB in FIG. 7B. FIG. 8C shows an example side cross sectional view of the valve 120 taken along line VIIIC-VIIIC in FIG. 7C. FIGS. 8A-8C show valve 120 in a normal (e.g., resting) state.

When valve 120 is in the normal (e.g., resting) state, valve 12 may be open. For example, when valve 120 is in the normal (e.g., resting) state, valve 120 may be open via opening 135. Slits 132 may form one or more respective openings 135 within orifice 131 of valve 120. Opening 135 may be formed in a centered (e.g., substantially centered) position of valve 120, for example, although opening may be formed in one more other positions, including one or more off-centered positions. In examples the opening 135 of valve 120 in the normal state may be less than (e.g., smaller than) the opening of the valve 120 when valve is in the dispensing state (FIG. 10). For example, the diameter, area, radius, circumference, length, width, etc. of the opening 135 of valve in the normal state may be less than the opening of the valve 120 when valve is in the dispensing state. As an example, the opening 135 of valve 120 in the resting state may be between 0.001 inches and 0.003 inches, although opening 135 may be larger or smaller in other examples. The opening 135 of valve 120 in the resting state may exist prior to pressure being applied to the container 100. In other examples opening 135 of valve 120 in the resting state may exist subsequent to pressure being applied to the container 100. The valve 120 may be in a resting state after (e.g., after a period of time in which) the fluidic material is moved from the chamber 102 of the container 100.

Opening 135 may be formed from one or more slits 132, although valve 120 may be open while in the normal state via an opening other than opening 135. One or more of the slits 132, such as slits 132*a*, 132*b*, may intersect one or more other slits. The intersection of the slits 132 may form one or more flaps, such as flaps 138*a*, 138*b*, 138*c* (collectively flaps 138). While the valve 120 is in the normal (e.g., resting) state, the flaps 138 may prohibit the fluidic material from dispensing from the chamber 102 of the container 100 through of 131. While the valve 120 is in another state (e.g., the dispensing state), the flaps 138 may allow the fluidic material to pass through orifice 131 of valve 120.

FIG. 9 shows the valve 120 in a state between the normal (e.g., resting) state and the opened (e.g., dispensing) state. That is, FIG. 9 shows the valve 120 in a state in which valve 120 is transitioning from the normal state (FIG. 8) to the dispensing state (FIG. 10), or in a state in which the valve 120 is transitioning from the dispensing state (FIG. 10) to the normal state (FIG. 8).

When transitioning from the normal state to the dispensing state, valve 120 may be in a pinching state. Also, or alternatively, when transitioning to the normal state from the dispensing state, valve 120 may be in a pinching state. The orifice 131 of valve 131 may be closed (e.g., substantially closed) when the valve 120 is in a pinching state. The valve 120 may assume a pinching state prior to the fluidic material being moved from the container 100 (e.g., chamber 102 of the container 100) or subsequent to the fluidic material being moved from the container 100.

As described herein, valve 120 may include one or more flaps 138, such as flaps 138*a*, 138*b*, 138*c*. Flaps 138*a*, 138*b*, 138*c* may be movable (e.g., independently movable). Flaps (such as flaps 138*a*, 138*b*) may include one or more respective edges, such as edges 133*a*, 133*b*. Edges 133*a*, 133*b* of the flaps 138 may be centered upon the orifice 131, although the edges 133*a*, 133*b* of the flaps 138 may be located other than the center of orifice 131 in examples. As shown on FIG. 9, the ethics 133*a*, 133*b* of the flaps 138*a*, 138*b* may contact one another when the valve 120 is in a pinching state. For example, opposite edges 133*a*, 133*b* of the flaps 138*a*, 138*b* may contact one another when the valve 120 is in a pinching state. The contacting of the edges 113*a*, 133*b* may result m the fluid being prevented from being dispensed from the chamber 102 of container 100 and/or the orifice 131 of valve 120. In an example, the contacting of the edges 133*a*, 133*b* may result in a string of the fluid (e.g., the viscous fluid) being pinched off by the edges 133*a*, 133*b* of the flaps 138. As an example, while the valve 120 is returning from a dispensing state to the normal state, the edges 133*a*, 133*b* of the flaps 138*a*, 138*b* may pinch off a string of the fluidic material.

FIG. 10 shows an example valve 120 in a dispensing state. The valve 120 may be configured to transition from a normal (e.g., resting) state to a dispensing state, and vice-versa. During the transition between the normal state and the dispensing state the valve 120 may assume a pinching state, as described herein. The valve 120 may be configured to transition to a dispensing state upon a pressure (e.g., discharge pressure) being applied to container 100 (e.g., sidewall 107 of container 100). The pressure to sidewall 107 may provide a force to chamber 102 that causes the fluidic material to move from the chamber 102 of container 100 to dispensing passageway 136. As the fluidic material moves through dispensing passageway 136 the fluidic material may approach the valve 120 (e.g., orifice 131 of valve 120).

The force pushing the fluidic material towards the orifice 131 may be great enough to cause the flaps 138*a*, 138*b* of the valve 20 to move in an outward (e.g., convex) position, as shown on FIG. 10. The flaps 138*a*, 138*b* of the valve 120 moving in an outward (e.g., convex) position may cause the valve 120 to form an opening 135 or increase opening 135. While the size of the opening 135 increases, a pinching of the edges 133*a*, 133*b* of the flaps 138*a*, 138*b* may be released. Fluidic material may be dispensed from the container 100 upon the fluidic material pushing open one or more of the flaps. The opening 135 of the valve 120 in the dispensing state may be greater than the opening 135 of the valve 120 in the normal state.

In the dispensing state the fluidic material 150 may push through the opening 135 and may be dispensed from the container 100. Upon release, or decrease, a pressure to the sidewall 107, a negative pressure may be provided. For example, a negative pressure may assist the container 100 with the return of the chamber 102 of the container 100. The negative pressure may also, or alternatively assist valve 120 (e.g., resilient valve) to move from the dispensing state to the normal state.

Valve 120 may be self-biased. For example, upon the cessation of the pressure and/or force to chamber 102, in which the fluid is being caused to move from chamber 102, valve 120 may return to the normal (e.g., resting) state. Valve 120 may return to the normal state without user intervention. For example, the valve 120 may return to the normal state due to (e.g., solely due to) the resiliency of the material forming the valve 120. As described herein, valve 120 may continue to be open when in the normal state.

Figure 11:
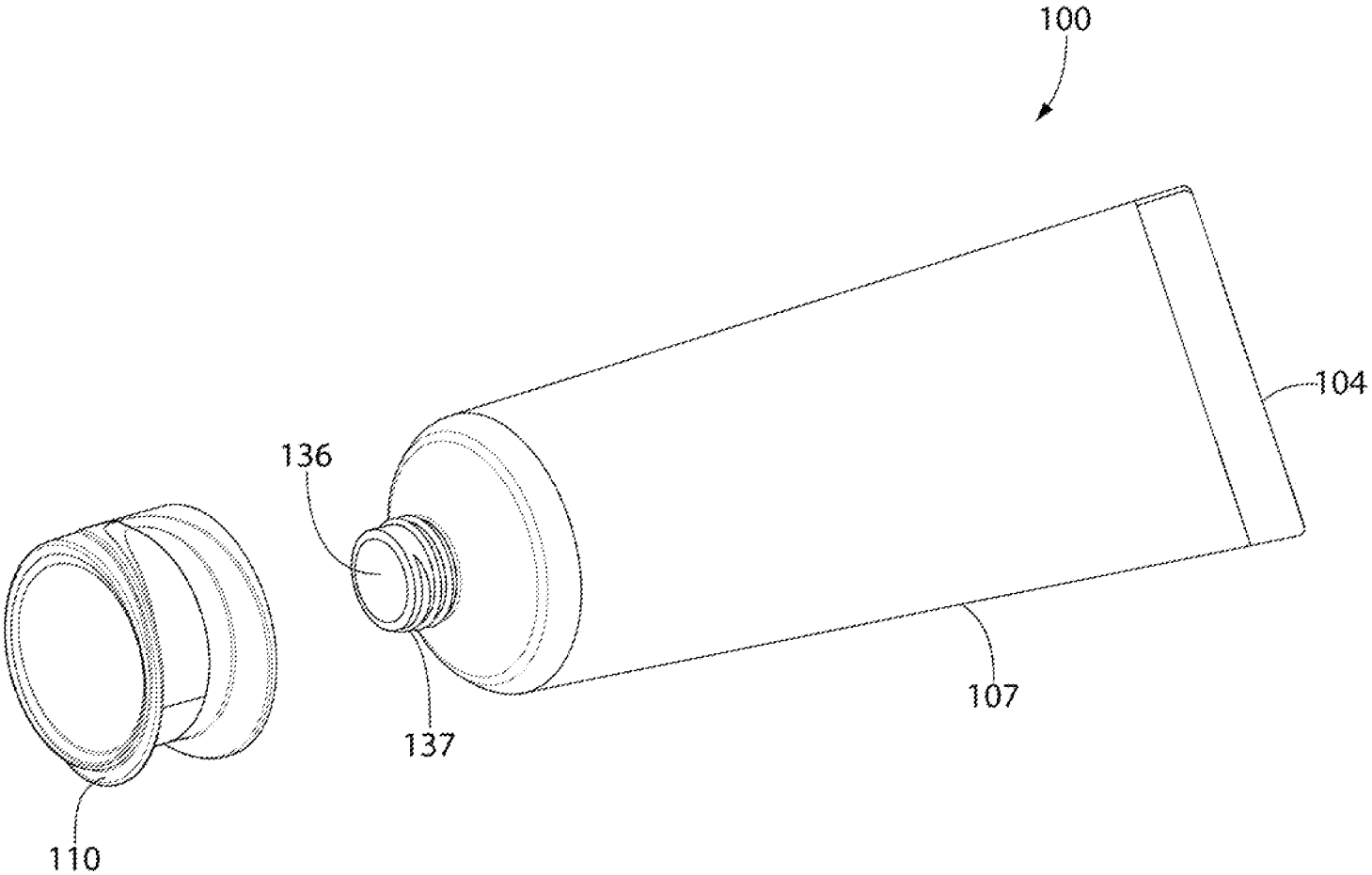
FIG. 11 is a perspective view of an example container in which the cap is not coupled to the container, as described herein.

FIG. 11 shows an example container in which the cap 110 may be detachably coupled to the container 102. In the example shown on FIG. 11, the cap 110 may be coupled to the container 102 via a threading 137 of the container 102.

Figure 12A:
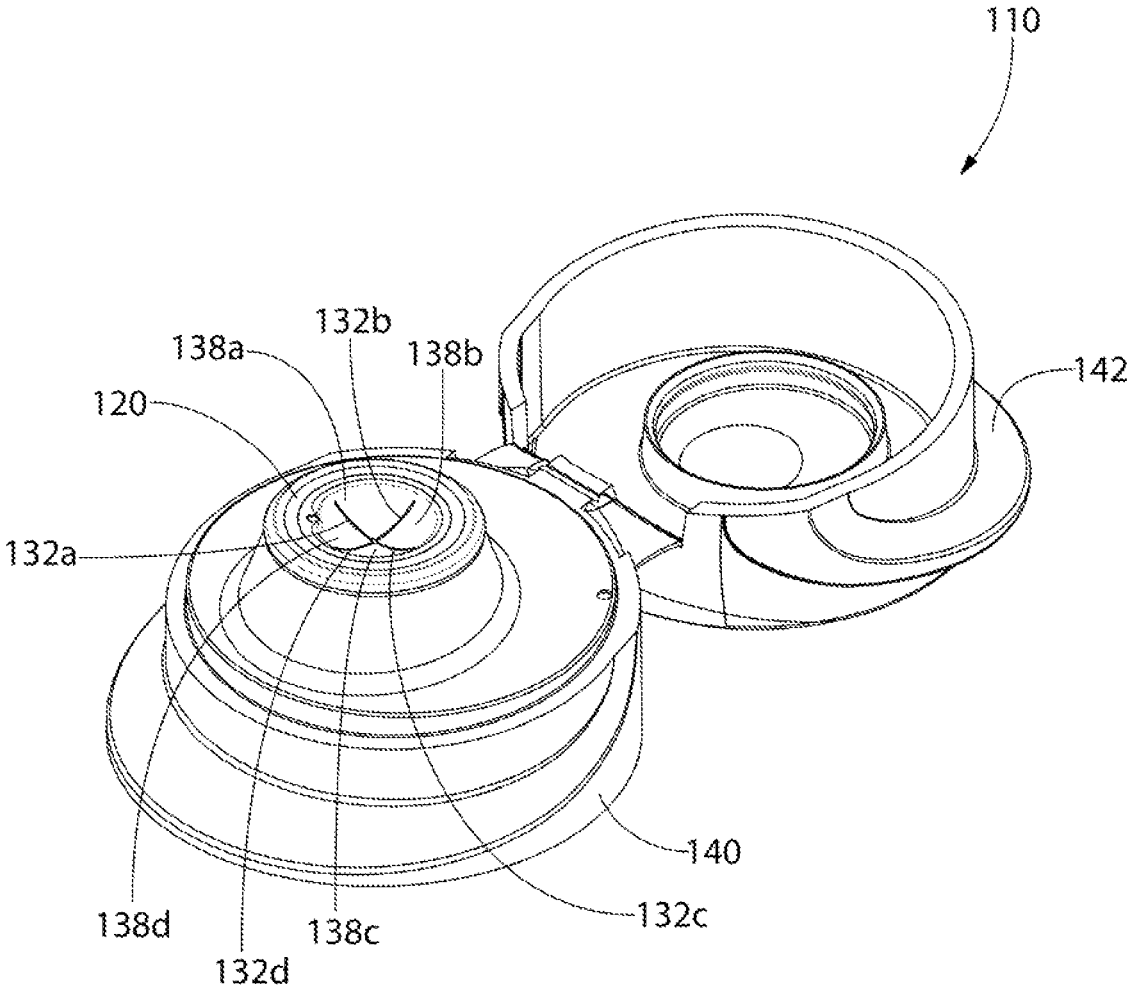
FIGS. 12A, 12B, 12C are top perspective views of the cap in an open configuration, as described herein.
Figure 12B:
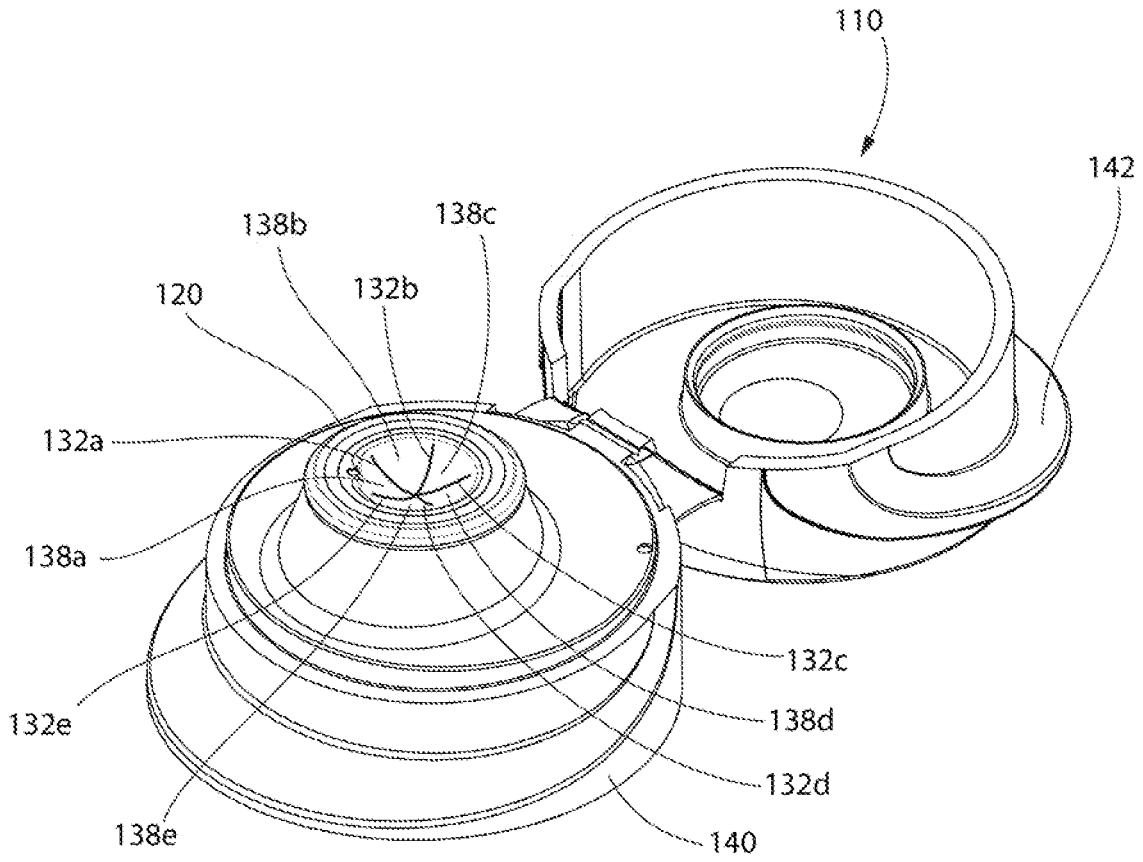
Figure 12C:
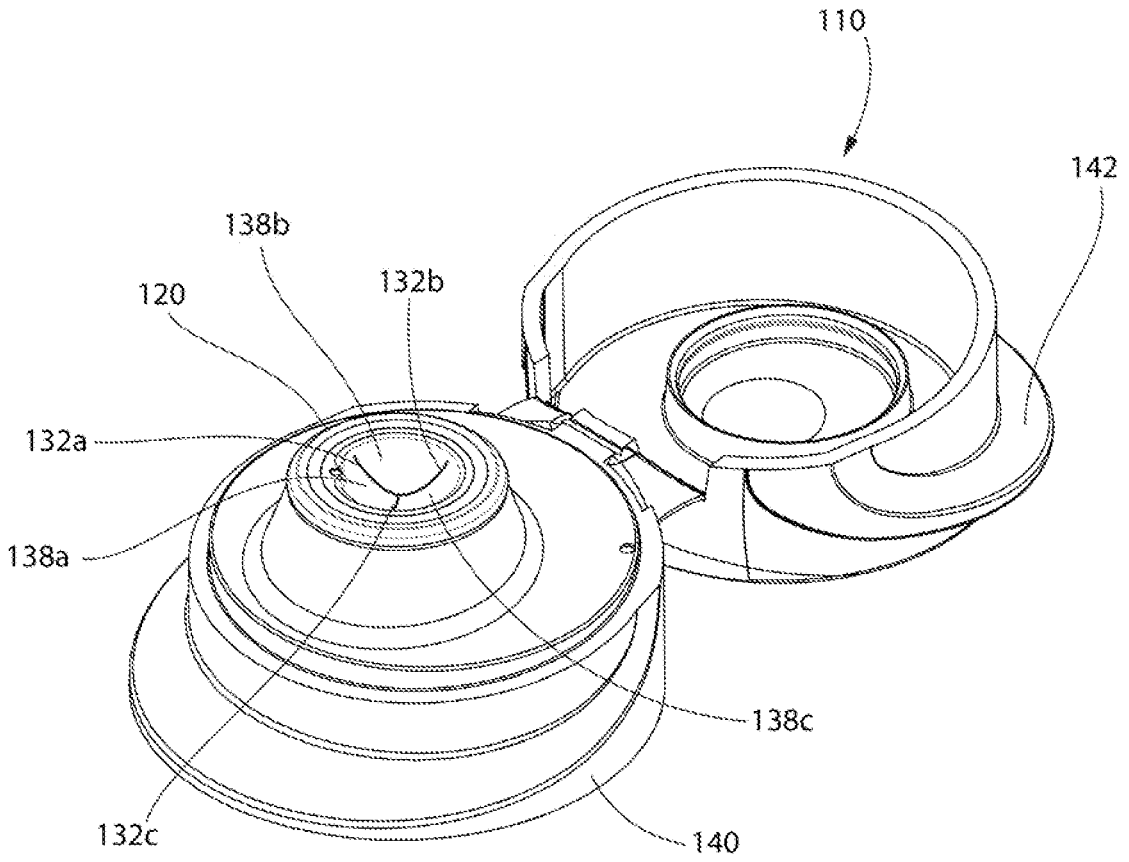

FIGS. 12A, 12B, 12C show examples of cap 110 in which the cap 110 is in an open state. Although FIGS. 12A 12B, 12C show cap 110 detached from container 110, one or more aspects of cap 110 shown on FIGS. 12A, 12B, 12C may exist for cap 110 when attached (e.g., permanently attached, temporarily attached) to container 110. Cap 110 may include a top portion 142 and a bottom portion 140, as described herein. Cap may include valve 120, although valve 120 and cap 110 may be separate components in examples. As described herein, valve 120 may include slits. For example, as shown on FIG. 12A, valve 120 may include slits 132*a*, 132*b*, 132*c*, 132*d*: as shown on FIG. 12B, valve 120 may include slits 132*a*, 132*b*, 132*c*, 132*d*, 132*e*; and as shown on FIG. 12C, valve 120 may include slits 132*a*, 132*b*, 132*c*. It should be understood that the type and number of slits 132 shown on FIGS. 12A-12C are for illustration purposes only. Valve 120 may include one or more shapes and styles of slits located in one or more locations of valve 120. For example, although in some examples two or more of the slits 132 may intersect one another, in other examples two or more of the slits 132 may not intersect one another. Slits 132 (e.g., intersecting slits) may form one or more flaps, as described herein.

Valve 120 may be coupled to dispensing passageway 136. Dispensing passageway 136 may extend from container 100. For example, dispensing passageway 136 may extend from chamber 102 of container 100, irrespective of cap 110. In other examples, dispensing passageway 136 may be formed via an alignment of container 100 and cap 110. In still other examples, dispensing passageway 136 may be formed within cap 110 (e.g., irrespective of container 100). In examples in which dispensing passageway 136 is formed within cap 110, valve 120 may be coupled to dispensing passageway 136 within cap 110.

Figure 13:
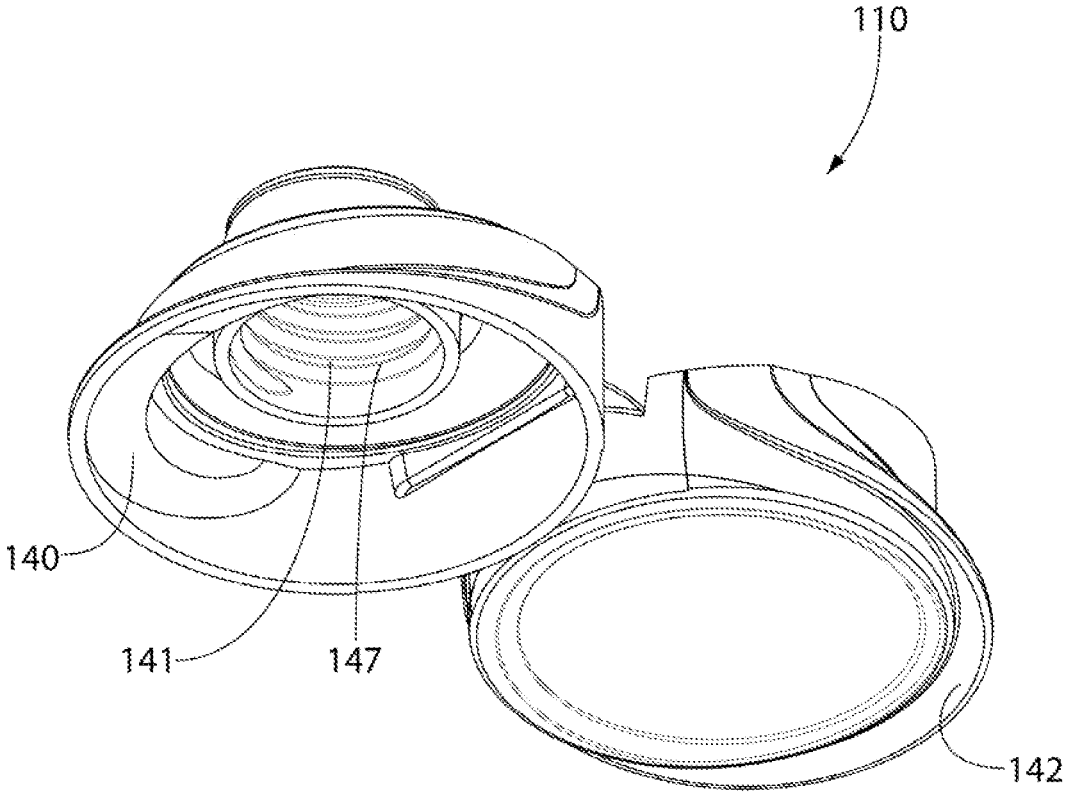
FIG. 13 is bottom perspective view of the cap in an open configuration, as described herein.

FIG. 13 shows a bottom perspective view of an example cap 110. As described herein, cap 110 may include a top portion 142 and a bottom portion 140. In examples cap 110 may include a cap orifice 141. In some examples cap orifice 141 may be configured to receive and/or couple to a dispensing passageway 136 of container 100, for example, via an interior threading 147. For example, cap orifice 141 may have an interior threading 147 that may engage with threading 137 of dispensing passageway 136. In other examples cap orifice 141 may form dispensing, passageway 136. In examples in which cap orifice 141 forms dispensing passageway 136, valve 120 may couple to cap orifice 141.

Figure 14:
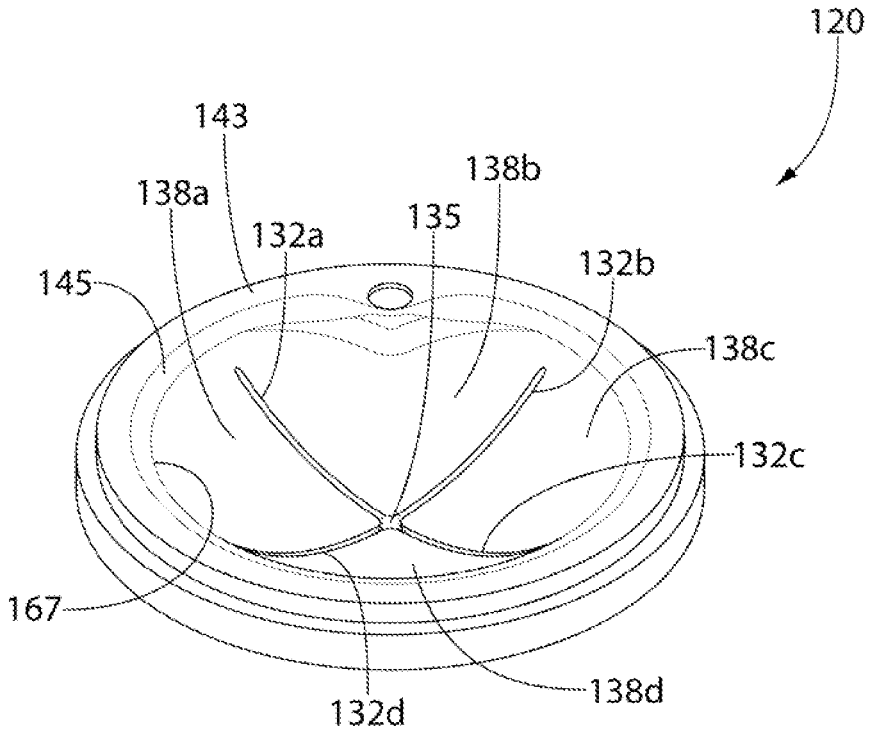
FIG. 14 is top perspective view of the valve in a normal stale, as described herein.

FIG. 14 shows a perspective view of an example valve 120. Although FIG. 14 shows a detached valve 120, valve 120 may be coupled to one or more devices, such as container 100 (e.g., dispensing passageway 136, shoulders 139, cap 110, anchor one or more locations of container 100). Valve 120 may define an orifice 131. Orifice 131 may provide an opening in which the fluidic material may pass from the chamber 102 of container 100.

Valve 120 may have a ring configuration, such as an annular ring 143 configuration. The annular ring 143 may define an opening (e.g., central opening) that may form an orifice 131 for dispensing the fluidic material. Valve 120 may include valve head 145. Valve head 145 may be supported by annular ring 143 within the central opening of valve 120. The annular ring 143 may have an upper-most surface and a bottom-most surface. The valve 120 may be coupled to the dispensing passageway 136 via the annular ring 143. For example, the valve may be mounted to the dispensing passageway 136 (e.g., nozzle) so that the upper-most surface of the annular ring 143 of the valve 120 is flush (e.g., substantially flush) with and/or surrounded by the distal-most surface (e.g., annular distal-most surface) of the nozzle, as described herein.

A component (e.g., a nozzle component) may include a nozzle. In such examples the nozzle may include a side surface (e.g., an outer side surface) that may extend downward from the annular distal-most surface. As described herein, the bottom portion 140 of cap 110 may include dispensing passageway 136 (e.g., nozzle) and/or the top portion 142 of cap 110 may include a closure (e.g., closing) component. The closure component may include a sealing element. The sealing element may include a wall (e.g., an annular wall). The annular wall may terminate in a distal edge surface. The distal edge surface may be inclined relative to a central axis of the annular wall. The outer side surface of the nozzle may be inclined relative to a nozzle axis of the nozzle.

The closure component may include a wall, such as an annular skin wall. The annular skirt wall may be spaced from and/or may circumscribe the annular wall. The annular skirt wall may engage an upper surface of the nozzle component. In an example the nozzle may protrude from the upper surface. A perimeter edge of the upper surface may define a perimeter. The perimeter may have a center, for example, when viewed from above. The nozzle axis may be spaced a distance from the center of the perimeter, such as in a first direction. Hinge mechanism 148 may be located a distance from the center of the perimeter. For example, hinge mechanism 148 may be located a distance from the center of the perimeter, in a second direction. The second direction may be opposite the first direction.

The closure component may be alterable between two or more states. For example, the closure component ma be alterable between a sealed state and a dispensing state. In the sealed state a sealing element may seal the dispensing opening. For example, the sealing element may seal the dispensing opening via engagement of the annular wall with an outer side surface of the nozzle. Further, in the sealed state, the annular distal-most surface of the nozzle and/or the upper-most surface of the annular ring 143 may be free of contact with the sealing element. In the dispensing state the dispensing opening may be unobstructed by the sealing element.

Orifice 131 may be defined by an orifice edge 167, which may be defined by valve head 145 and/or annular ring 143. For example, in the normal state valve head 145 (e.g., a portion of valve head 145) may be located below a surface (e.g., a bottom most surface) of the annular ring 143.

Figure 15:
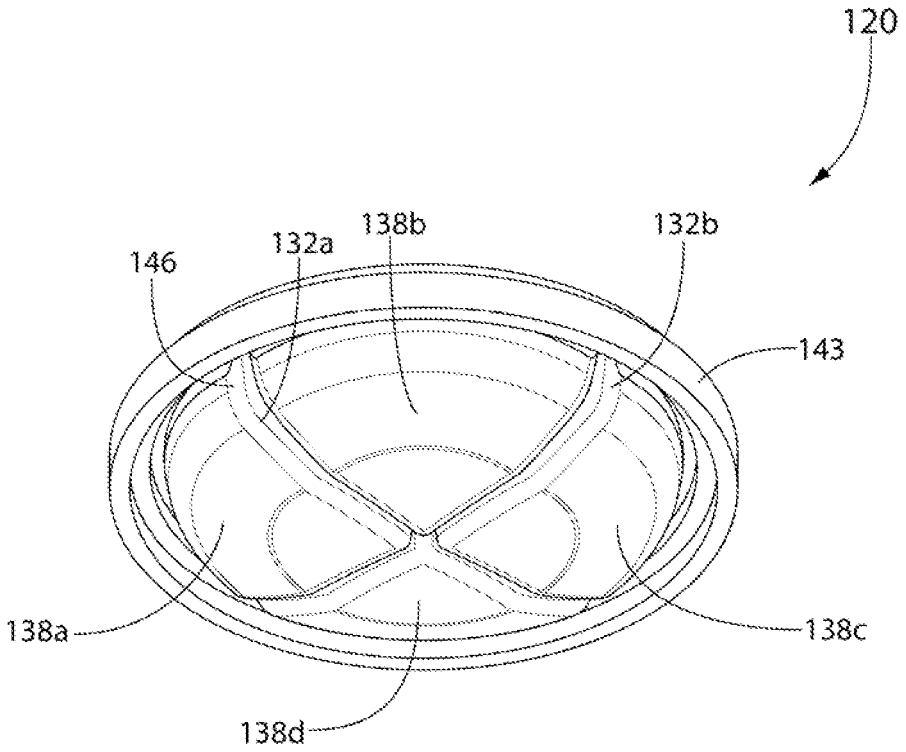
FIG. 15 is a bottom perspective view of the valve, as described herein.

FIG. 15 shows a bottom perspective view of a valve, such as valve 120. As shown on FIG. 15, valve 120 may include annular ring 143 and one or more slits, such as slits 132*a*, 132*b*, 132*c*, 132*d*, that may be positioned within annular ring 143. Slits 132*a*, 132*b*, 132*c*, 132*d* may form an opening, such as opening 135. Opening may be centrally formed between one or more of the slits 132*a*, 132*b*, 132*c*, 132*d*. In other examples opening 135 may be off-center. One or more of slits 132 may be adjacent to or formed from one or more coverings 146. Coverings 146 may be raised in some examples. Coverings 146 may be formed of the same material as the valve 120, although in examples coverings 146 and valve 120 may be formed of other materials. Coverings 146 may prohibit or reduce the fluidic material from traveling through the valve 120 (e.g., through slits 132 of valve 120) when valve 120 is in a normal state, for example.

Slits 132*a*, 132*b*, 132*c*, 132*d* may form one or more respective flaps 138*a*, 138*b*, 138*c*, 138*d*. One or more of the flaps may remain in a normal (e.g., rest) state, and/or one or more of the flaps 138 may move (e.g., move independently) in an outward and/or inward direction. For example, in a dispensing state one or more of the flaps 138 may move (e.g., move independently) in an outward direction. The dispensing state may be invoked when a pressure is applied to the container 100, such as a pressure being applied to a sidewall 107 of the container 100. When the flaps 138 move in an outward direction, the flaps 138 may be in a convex position. One or more portions of valve 120 may be resilient. For example, as described herein, one or more flaps 138 of valve 120 may be configured to recoil or spring back into shape after bending, stretching, or being compressed.

Figure 16:
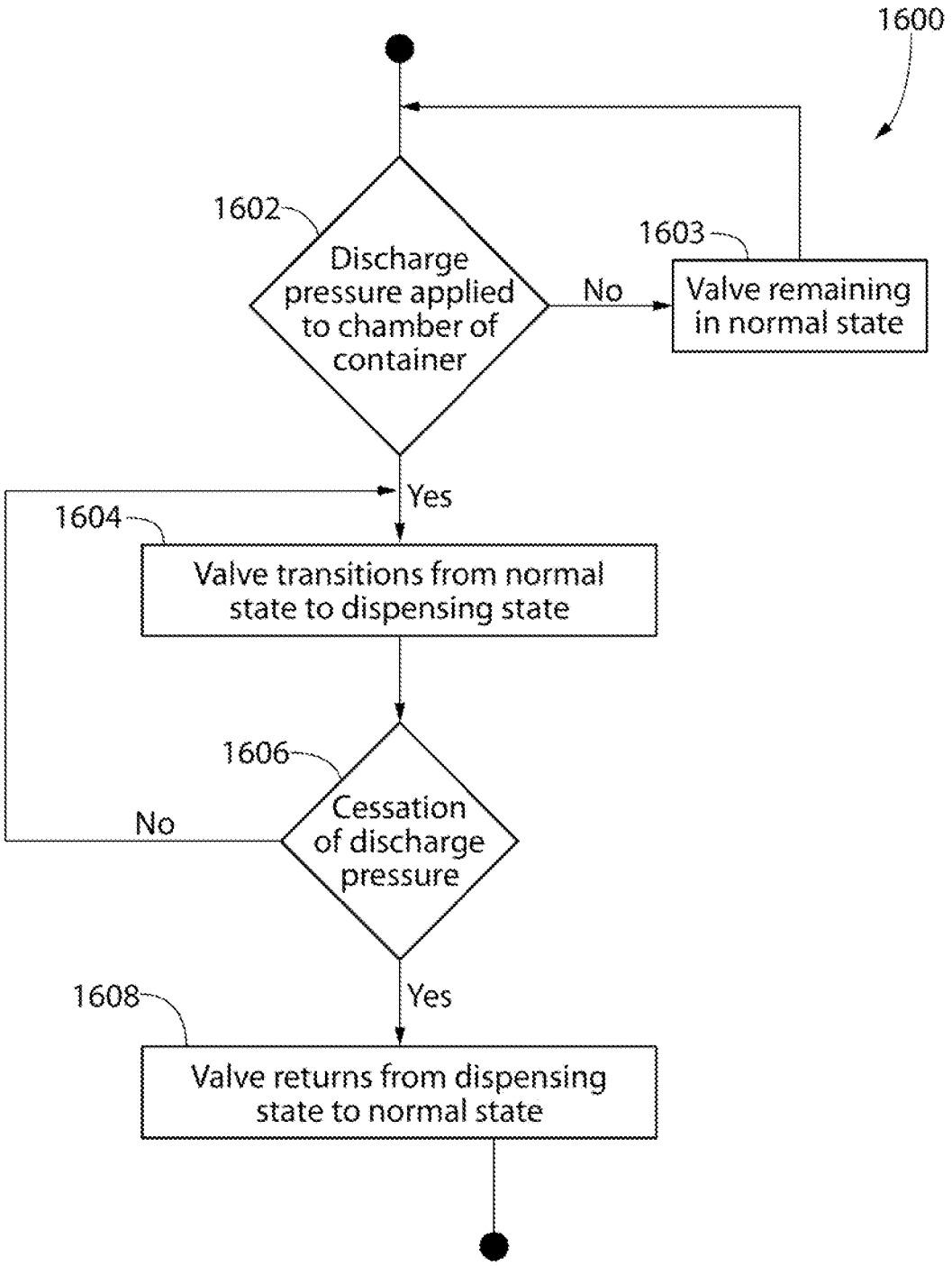
FIG. 16 is an example process demonstrating use of the valve, as described herein.

FIG. 16 shows an example process 1600 demonstrating use of a valve. For example, FIG. 16 shows an example process demonstrating use of valve 120 having an orifice 131. Valve 120 may be positioned upon a container 100, as described herein. For example, valve 120 may be positioned in and/or coupled to a passageway such a a dispensing passageway 136. Valve 120 may be in a normal state. Orifice 131 (e.g., a portion of orifice 131) max be open while valve 120 is in the normal state. While in the normal state, fluid (e.g., viscous fluid, such as a toothpaste) may be retained in the container.

At 1602, a discharge pressure is applied to container 100, such as to chamber 102 of container 100. Discharge pressure may be applied to container 100 when valve 120 is in a normal state. After the application of the discharge pressure valve 120 may transition from a normal state to a dispensing state, at 1604. The valve 120 transitioning from the normal state to the dispensing state may allow a fluid to pass through orifice 131 of valve 120, for example, while the valve 120 is in the dispensing state. If discharge pressure is not applied to container 100, valve 120 may remain in a normal state, at 1603.

At 1606, it may be determined whether the discharge pressure has ceased. If the discharge pressure has not ceased, the valve 120 may continue to transition to the dispensing state, at 1604. In other examples, if the discharge pressure has not ceased, the valve may transition (e.g., transition fully) to the dispensing state.

If the discharge pressure has ceased, go to 1608. At 1608, valve 120 returns from the dispensing, state to the normal state. During the transition from the dispensing state to the normal state the valve 120 may assume a pinching state. While in the pinching state, valve (e.g., portions of valve 120, such as edges of flaps of valve) may pinch off the fluidic material previously being dispensed by container 100, as described herein. As described herein, valve 120 may be open while in the normal state.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments ma be utilized and structural and functional modifications may be made without departing from the scope of the present invention. Thus, the spirit and scope of the invention should be construed broadly as set forth in the appended claims.

What is claimed is:

1. A container comprising:

a chamber containing a viscous fluidic material;

a dispensing passageway for discharging the viscous fluidic material from the chamber;

a resilient valve operably coupled to the dispensing passageway, the resilient valve comprising:

a valve head; and an orifice in the valve head, the orifice defined by an orifice edge of the valve head; and a nozzle comprising at least a portion of the dispensing passageway, the nozzle terminating in an annular distal-most surface that defines a dispensing opening of the dispensing passageway;

the resilient valve configured to: (1) transition from a normal state to a dispensing state upon a discharge pressure being applied to the chamber to allow the viscous fluidic material to be passed through the orifice of the resilient valve and be dispensed from the dispensing passageway as a string of the viscous fluidic material, the orifice being open in the normal state; and (2) return from the dispensing state to the normal state upon cessation of the discharge pressure, the resilient valve assuming a pinching state while returning from the dispensing state to the normal state in which the string of the viscous fluidic material is pinched off by the orifice edge;

the resilient valve comprising an annular ring defining a central opening, the valve head supported by the annular ring within the central opening, the annular ring comprising an upper-most surface; and the resilient valve mounted within the nozzle so that the upper-most surface of the annular ring of the resilient valve is substantially flush with and surrounded by the annular distal-most surface of the nozzle.

2. The container according to claim 1 wherein the resilient valve is self-biased into the normal state to assist with the return of the resilient valve from the dispensing state to the normal state.

3. The container according to claim 1 wherein, in the normal state, the orifice is opened a first amount; and wherein, in the dispensing state, the orifice is open a second amount, the second amount being greater than the first amount.

4. The container according to claim 1 wherein, in the pinching state, opposite portions of the orifice edge contact one another and the orifice is substantially closed.

5. The container according to claim 1 wherein the orifice comprises a plurality of slits that intersect one another, thereby forming a plurality of flaps.

6. The container according to claim 1 wherein, in the normal state, the valve head comprises a convex inner surface and a convex outer surface.

7. The container according to claim 1 wherein, in the normal state, at least a portion of the valve head is located below a bottom-most surface of the annular ring.

8. The container according to claim 1 wherein:

the nozzle is formed of a hard plastic; and the resilient valve is overmolded to the nozzle within the portion of the dispensing passageway, wherein the orifice of the resilient valve is formed during the overmolding process.

9. The container according to claim 1 further comprising a collapsible tube comprising the chamber, wherein the collapsible tube comprises a wall formed of a multi-layer sheet comprising a flavor barrier layer formed of a copolymer, wherein the collapsible tube generates a negative pressure upon cessation of the discharge pressure, the negative pressure assisting with the return of the resilient valve from the dispensing state to the normal state.

10. The container according to claim 1 further comprising:

a nozzle component comprising the nozzle, the nozzle comprising an outer side surface extending downward from the annular distal-most surface;

a closure component comprising a sealing element comprising an annular wall, the closure component alterable between: (1) a sealed state in which the sealing element seals the dispensing opening via engagement of the annular wall with the outer side surface of the nozzle; and (2) a dispensing state in which the dispensing opening is unobstructed by the sealing element.

11. The container according to claim 10 wherein, in the sealed state, the annular distal-most surface of the nozzle and the upper-most surface of the annular ring of the resilient element are free of contact with the sealing element.

12. The container according to claim 10 wherein the annular wall of the sealing element terminates in a distal edge surface that is inclined relative to a central axis of the annular wall; and wherein the outer side surface of the nozzle is inclined relative to a nozzle axis of the nozzle.

13. The container according to claim 10 wherein the closure component further comprises an annular skirt wall spaced from and circumscribing the annular wall; and wherein the annular skirt wall engages an upper surface of the nozzle component, the nozzle protruding from the upper surface, wherein a perimeter edge of the upper surface defines a perimeter having a center when viewed from above, the nozzle axis spaced a distance from the center of the perimeter in a first direction, and further comprising a hinge coupling the nozzle component to the closure component; and wherein the hinge is located a distance from the center of the perimeter in a second direction opposite the first direction.

14. A method of dispensing a viscous fluidic material from a container comprising:

a) upon a discharge pressure being applied to a chamber of the container, a resilient valve positioned in a dispensing passageway transitioning from a normal state to a dispensing state, thereby allowing the viscous fluidic material to pass through an orifice of the resilient valve, the orifice being open in the normal state, the resilient valve comprising an annular ring defining a central opening, a valve head of the resilient valve being supported by the annular ring within the central opening, the annular ring comprising an upper-most surface, the resilient valve mounted within a nozzle of the container so that the upper-most surface of the annular ring of the resilient valve is substantially flush with and surrounded by the annular distal-most surface of the nozzle; and b) upon cessation of the discharge pressure, the resilient valve returning from the dispensing state to the normal state, the resilient valve assuming a pinching state while returning from the dispensing state to the normal state in which the string of the viscous fluidic material is pinched off by the orifice edge.

* * * * *